US006962556B2

(12) United States Patent
Tisma et al.

(10) Patent No.: US 6,962,556 B2
(45) Date of Patent: Nov. 8, 2005

(54) SYSTEM AND METHOD FOR ASSEMBLING A PACKAGE WITH A FLIP-TOP

(75) Inventors: Petar Tisma, Glenview, IL (US); Yugoslav Kokotovic, Elk Grove Village, IL (US); Radoje Bajic, Addison, IL (US); Stevan Tisma, Schaumburg, IL (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/633,337

(22) Filed: Aug. 1, 2003

(65) Prior Publication Data

US 2005/0026762 A1 Feb. 3, 2005

(Under 37 CFR 1.47)

(51) Int. Cl.[7] ..... B31B 1/50

(52) U.S. Cl. ..... 493/184; 493/164; 493/911; 53/377.6

(58) Field of Search ..... 493/184, 164, 493/139, 911, 165, 163, 452; 53/138.1, 377.6, 377.5, 574

(56) References Cited

U.S. PATENT DOCUMENTS

| | | | | |
|---|---|---|---|---|
| 2,842,920 | A | | 7/1958 | Carkhuff et al. |
| 3,032,947 | A | | 5/1962 | Voller |
| 3,094,265 | A | | 6/1963 | Hovland |
| 3,583,131 | A | | 6/1971 | Gaudlitz |
| 3,877,630 | A | | 4/1975 | Silver |
| 3,956,865 | A | | 5/1976 | Schmermund |
| 3,990,210 | A | | 11/1976 | McDonough et al. |
| 4,046,308 | A | | 9/1977 | Silver |
| 4,196,563 | A | | 4/1980 | Gabrielson et al. |
| 4,201,027 | A | * | 5/1980 | Ilsemann ..... 53/53 |
| 4,523,422 | A | | 6/1985 | Ilsemann |
| 4,548,593 | A | | 10/1985 | Tisma |
| 4,578,929 | A | | 4/1986 | Tisma |
| 4,612,752 | A | | 9/1986 | Deal |
| 4,856,566 | A | | 8/1989 | Tisma |
| 5,010,929 | A | | 4/1991 | Tisma |
| 5,058,634 | A | | 10/1991 | Tisma |
| 5,070,681 | A | | 12/1991 | Romagnoli |
| 5,144,790 | A | | 9/1992 | Tisma |
| 5,157,896 | A | | 10/1992 | Tisma |
| 5,167,607 | A | * | 12/1992 | Larsen ..... 493/183 |
| 5,551,210 | A | | 9/1996 | Williamson |
| 5,642,599 | A | | 7/1997 | Tisma |
| 5,806,289 | A | | 9/1998 | Sassi et al. |
| 6,073,423 | A | | 6/2000 | House et al. |
| 6,195,959 | B1 | | 3/2001 | Tisma |
| 6,223,507 | B1 | | 5/2001 | Tisma |
| 6,363,696 | B1 | | 4/2002 | Tisma |

* cited by examiner

*Primary Examiner*—Sameh H. Tawfik
(74) *Attorney, Agent, or Firm*—Foley & Lardner

(57) ABSTRACT

An automatic packaging machine for forming a latching flip-top box from a blank. A plurality of mandrels are coupled to a conveyor system. Each of the mandrels include a mounting block for coupling the mandrel to the automatic packaging machine, a package-holding assembly operatively connected to the mounting block and being rotatable about a first axis from a first position to a second position, and a flap holder assembly operatively connected to the mounting block. The flap holder assembly is rotatable about a second axis substantially perpendicular to the first axis. A plurality of plows and tucker assemblies sequentially manipulate portions of the blank in order to form portions of the box.

10 Claims, 15 Drawing Sheets

SYSTEM AND METHOD FOR ASSEMBLING A PACKAGE WITH A FLIP-TOP

FIELD OF THE INVENTION

The present invention relates generally to automatic packaging machines. More particularly, the present invention relates systems and method for assembling self-latching boxes and/or packages with a flip top.

BACKGROUND OF THE INVENTION

Various types of automatic packaging machines are known and used for assembling paperboard and/or cardboard packages from precut box blanks. These packages can be used to hold a wide variety of items, ranging from chewing gum to candy to office supplies: U.S. Pat. Nos. 4,578,929; 4,548,593; 4,716,714; 4,829,751; 4,856,566; 4,982,556; 5,010,929; 5,072,573; 5,144,790; and 6,195,959 are examples of packaging machines which may be used to load small items into different types of packages.

Conventional automatic packing machines include a conveyor, usually an endless link chain conveyor, which travels through or past a number of work stations extending between a magazine containing package blanks and a product discharge end. Usually, the package blanks are a stack of die cut paperboard or cardboard blanks which are picked up one-at-a-time by vacuum cups and then put into package-forming mandrels carried by the conveyor. Panels and flaps on the bottom of the blank are folded by a series of plows and sealed in order to close the package. A pre-determined amount of product is then placed in the package. Next, panels and flaps forming a top of the package are folded and sealed. Then the package is discharged onto any suitable conveyor, into a shipping carton, or to another device for receiving the completed product containing packaging.

Conventionally, a plow is a strip of metal, or the like, extending along a length of the conveyor and in a location where the panels and flaps are to be folded. First, panels and flaps forming the bottom of the package encounter the plows and then are folded as the conveyor carries the package past the plow. Then, a pre-determined amount of product is placed in the package. Next, panels and flaps forming a top of the package are folded and sealed in a similar manner. Depending upon product packaging needs, the package may or may not be wrapped in a transparent film which is sealed. Finally, the package is discharged onto any suitable conveyor, into a shipping box or another suitable device for receiving the product containing package.

Often, the product presents special considerations which require the packaging machine to perform unique functions as the package is formed and filled. These functions may be performed by special parts which are attached to or positioned near the conveyor. Many examples of such special parts are shown and described in the above-cited patents.

One type of conventional package which is often used for candy and mints is commonly referred to as a "flip-top" box or package. Such a package is made from a single, unitary, die cut blank of thin cardboard stock. A flip-top package has a bottom section which is in the form of a rectangular parallelepiped. The top of the package is in the form of a hood connected to the bottom along a crease line which acts as a hinge. The hood moves away from or over the top of the package in order to open or close it. It is necessary for the packaging machine to first form the blank into the package, then count a specific number of small items, such as candy coated chewing gum, next deposit them in the package, and finally close and seal the package. One such "flip-top" package is shown in prior art FIG. 1.

Prior art FIG. 2 shows one type of example automatic packaging machine for assembling the type of "flip-top" package of FIG. 1. This machine is described in detail in U.S. Pat. No. 6,195,959 and is incorporated herein by reference. This system uses a two-part mandrel which is joined by a single hinge. One of the two hinged parts includes a roller thereon for following a cam track having a quarter turn spiral therein. As the roller follows the spiral causing one hinged part to move through a quarter turn, the flip-top is folded over and formed.

In the conventional "flip-top" package shown in FIG. 1, the hinge of the flip-top joins the flip-top to the entire width of the (longer) major plane of the package. As a result, when the flip-top is opened, the entire top area of the package is exposed. Recently, however, a new type of "flip-top" package has been developed. This new package is shown at 98 in FIG. 3. The package 98, like the conventional package of FIG. 1, includes a flip-top 101 hingedly connected to an upper portion 103 of the package. Unlike the conventional package, however, the flip-top's hinge 105 runs along the (shorter) minor plane of the package, substantially perpendicular to the hinge line of the conventional "flip top" package. Furthermore, the hinge 105 runs across the middle of the package top, unlike the conventional package. As a result, the new package 98 has a hole 108 within a side panel 106 of the package 98 instead of having the top entirely open when the flip-top 101 is "flipped open."

This new type of "partial flip-top" package requires several more distinct flaps than the previous packages, which adds a significant amount of complexity to any machine for assembling and filling the packages. In particular, problems arise because the mandrels used in the conventional assembly devices are not properly aligned to fold down the top panels of the package blank to form the flip-top of the package. Several additional steps are therefore required to complete the assembly process. This results in increased complexity and assembly time, diminishing the assembly machine's efficiency.

SUMMARY

It is therefore one object of the invention to provide an improved system and method for assembling a "flip top" package.

It is another object of the invention to provide a system and method for assembling a "flip-top" package where the flip-top of the package is hingedly connected to the top of the package along a hinge line running through the middle of the package top.

It is another object of the invention to provide a system and method for assembling a "flip-top" package that includes a minimal amount of manual labor.

It is still another object of the invention to provide a system and method for assembling a "flip-top" package that can be assembled in a minimal amount of time.

In accordance with the invention and the above examples of objects, a system and method is provided for assembling a "partial flip-top" box or package in a highly efficient manner. In a preferred embodiment, a plurality of mandrels are coupled to an "endless link" chain conveyor. Each mandrel includes a mounting bracket for coupling the mandrel to a rail. The bracket is operatively connected to a package-holding subassembly. The package-holding assembly includes a gripping mechanism for holding the package blank during assembly. The package-holding assembly is rotatable about a first axis relative to the rest of the mandrel. A flap holder subassembly is also operatively connected to the bracket. The flap holder assembly is rotatable about a second axis substantially perpendicular to the first axis. The rotation of the package-holding assembly permits the package blank to be moved into various orientations such that the blank can be quickly and efficiently assembled into a "partial flip-top" package. In one preferred embodiment of the invention, the system and method results in up to 400 partial flip-top packages being assembled per minute.

DETAILED DESCRIPTION OF THE PREFERRED EMBODIMENTS

Figure 3:
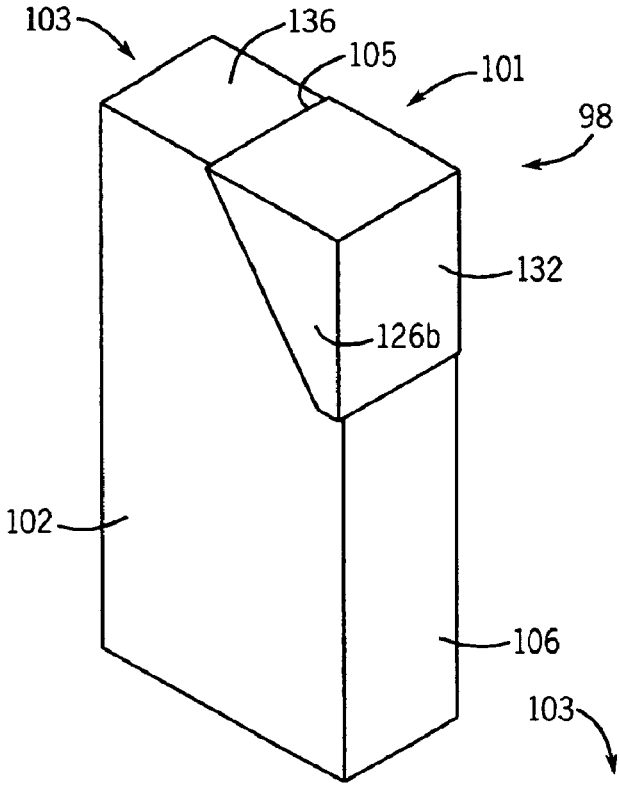
FIG. 3 is a perspective view of a latching "partial" flip-top package in the closed position.
Figure 4:
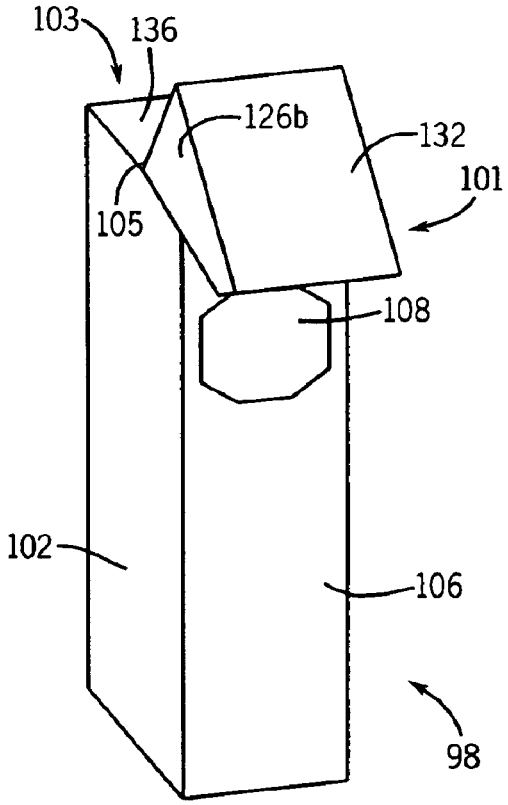
FIG. 4 is a perspective view of the package of FIG. 3 in the open position.

FIGS. 3 and 4 show a paperboard package 98 including a "partial" latching flip-top package flip-top 101 which is folded, formed, filled, and sealed by an automatic package machine according to one form of the invention. The package 98, has the flip-top 101 hingedly connected to an upper portion 103 of the package 98. The hinge 105 between the flip-top 101 and the upper portion 103 runs along the (shorter) minor plane of the package, substantially perpendicular to where the hinge line would be on a conventional "flip top" package. The hinge 105 runs across the middle of the upper portion 103. The package 98 includes a hole 108 within a minor side panel 106 of the package 98 instead of having the top entirely open when the flip-top 101 is "flipped open." In this new package, the hole 108 is exposed when the flip-top 101 is flipped open, as shown in FIG. 4, and the hole 108 is unexposed when the flip-top 101 is closed.

Figure 5:
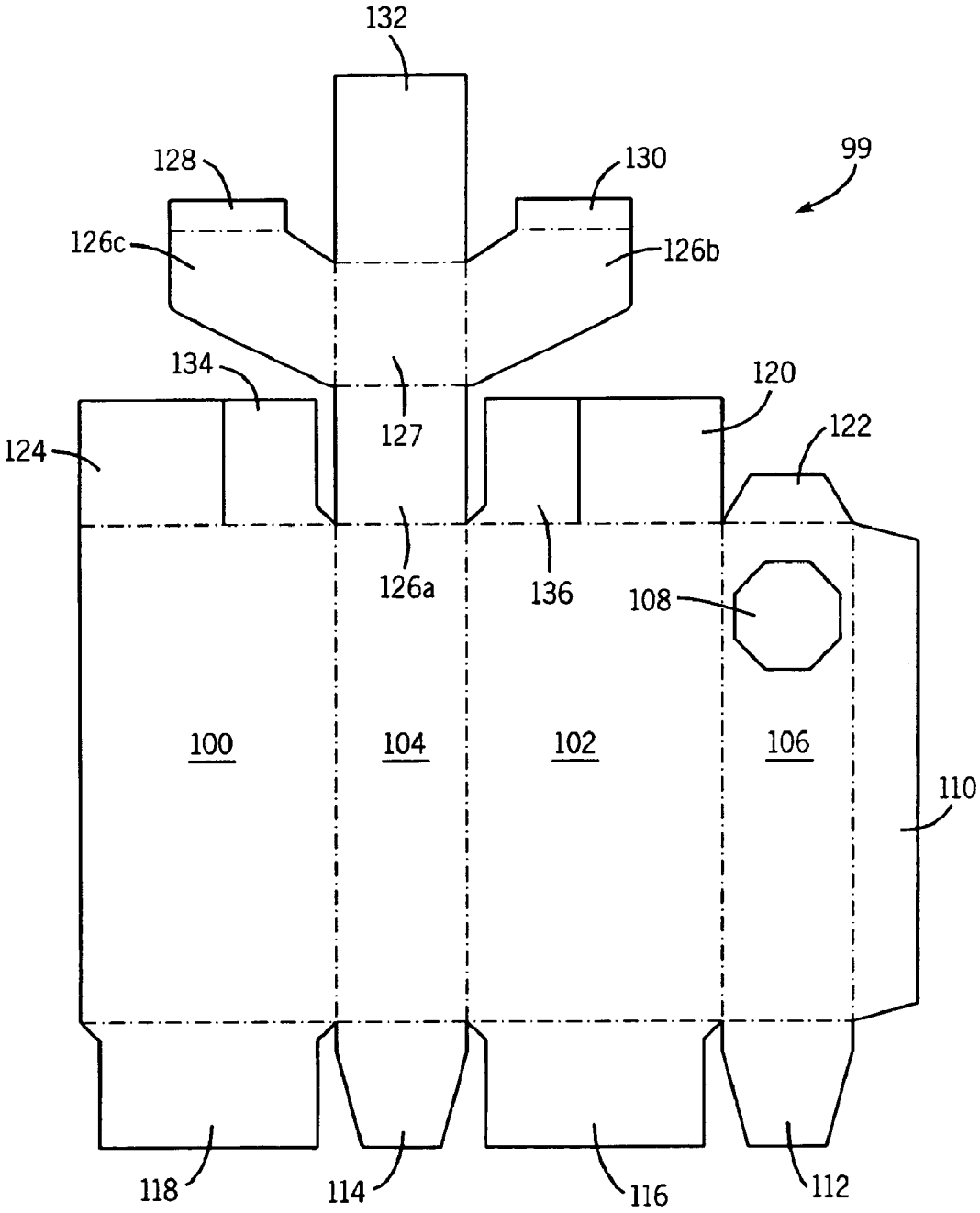
FIG. 5 is a plan view of a fully unassembled package blank for the package of FIG. 3 (viewing the outside surface of the blank)
Figure 6:
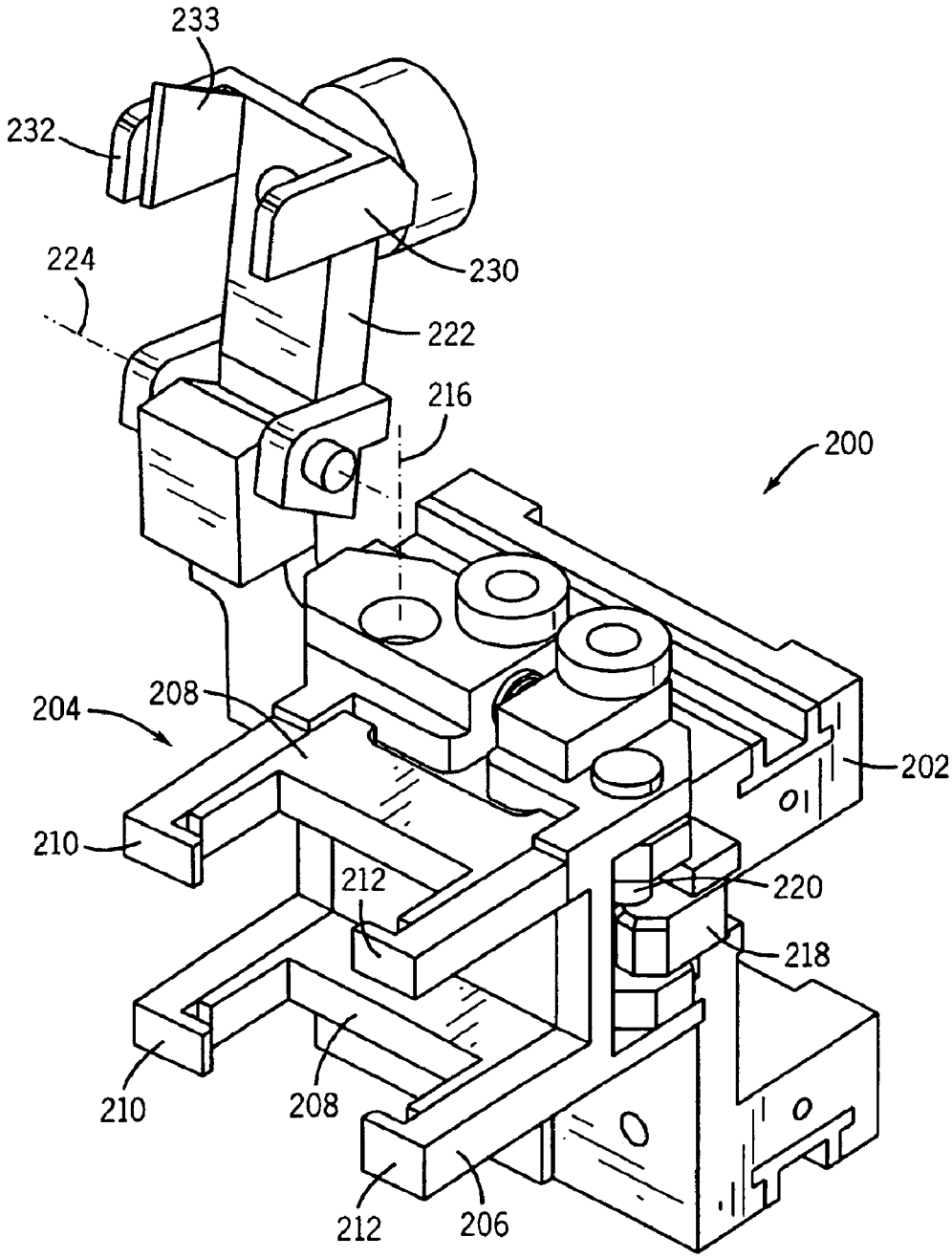
FIG. 6 is a perspective view of a mandrel used to form and close the flip-top package of FIG. 3, with the mandrel including a package-holding assembly in a fully retracted position.
Figure 7:
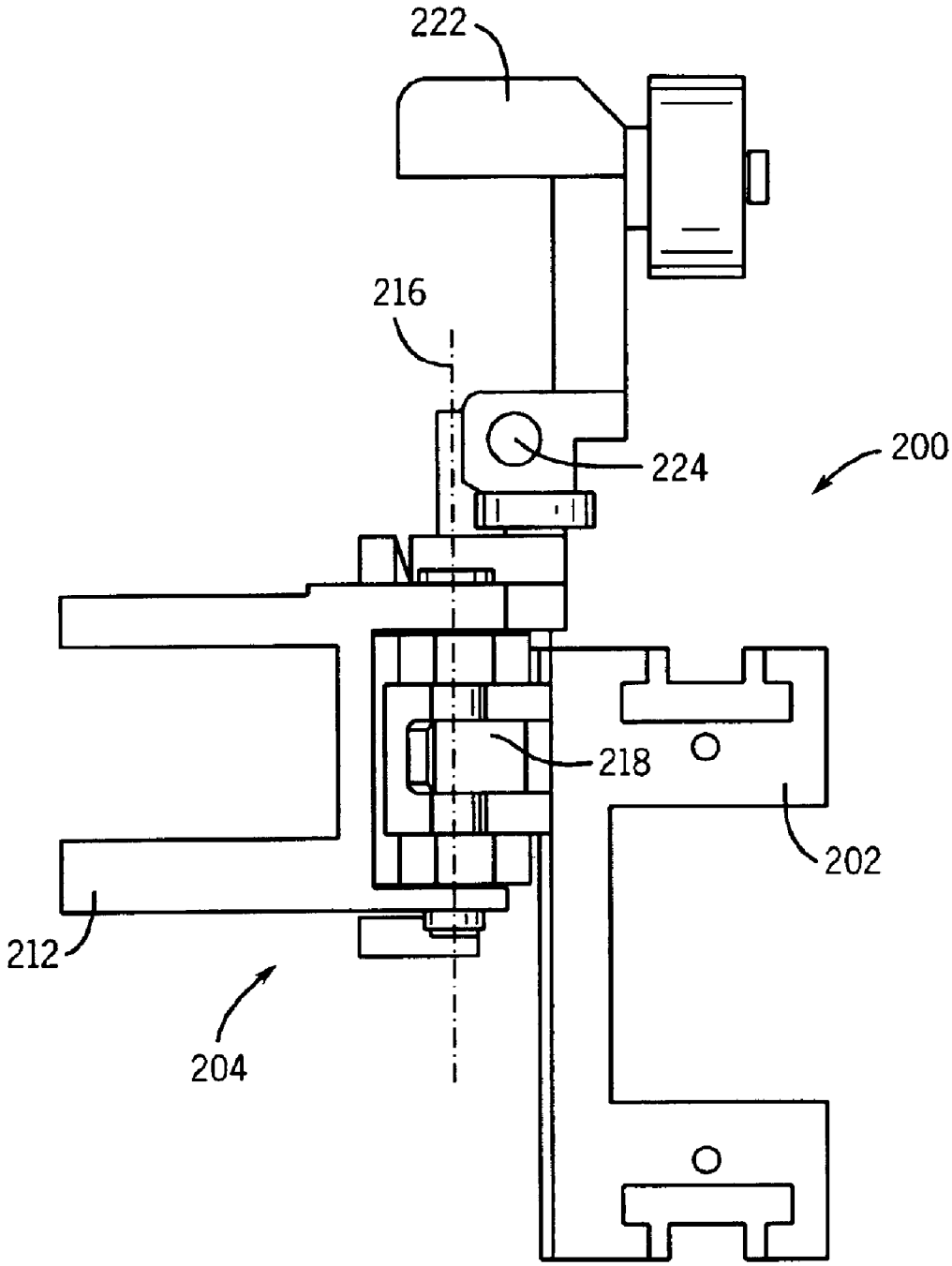
FIG. 7 is a side view of the mandrel of FIG. 6.
Figure 8:
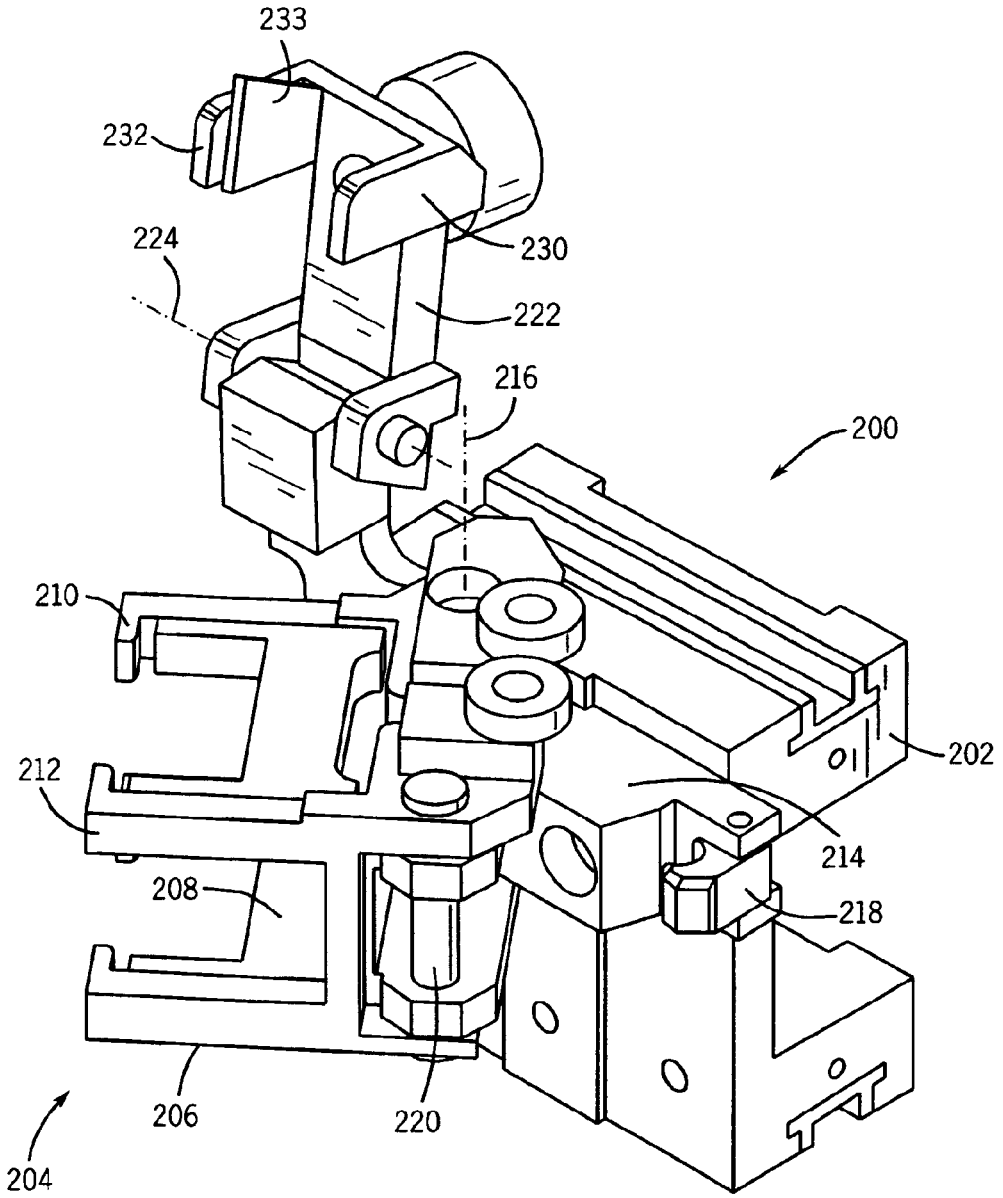
FIG. 8 is a perspective view of the mandrel of FIG. 6 with the package-holding assembly in a partially rotated position.
Figure 9:
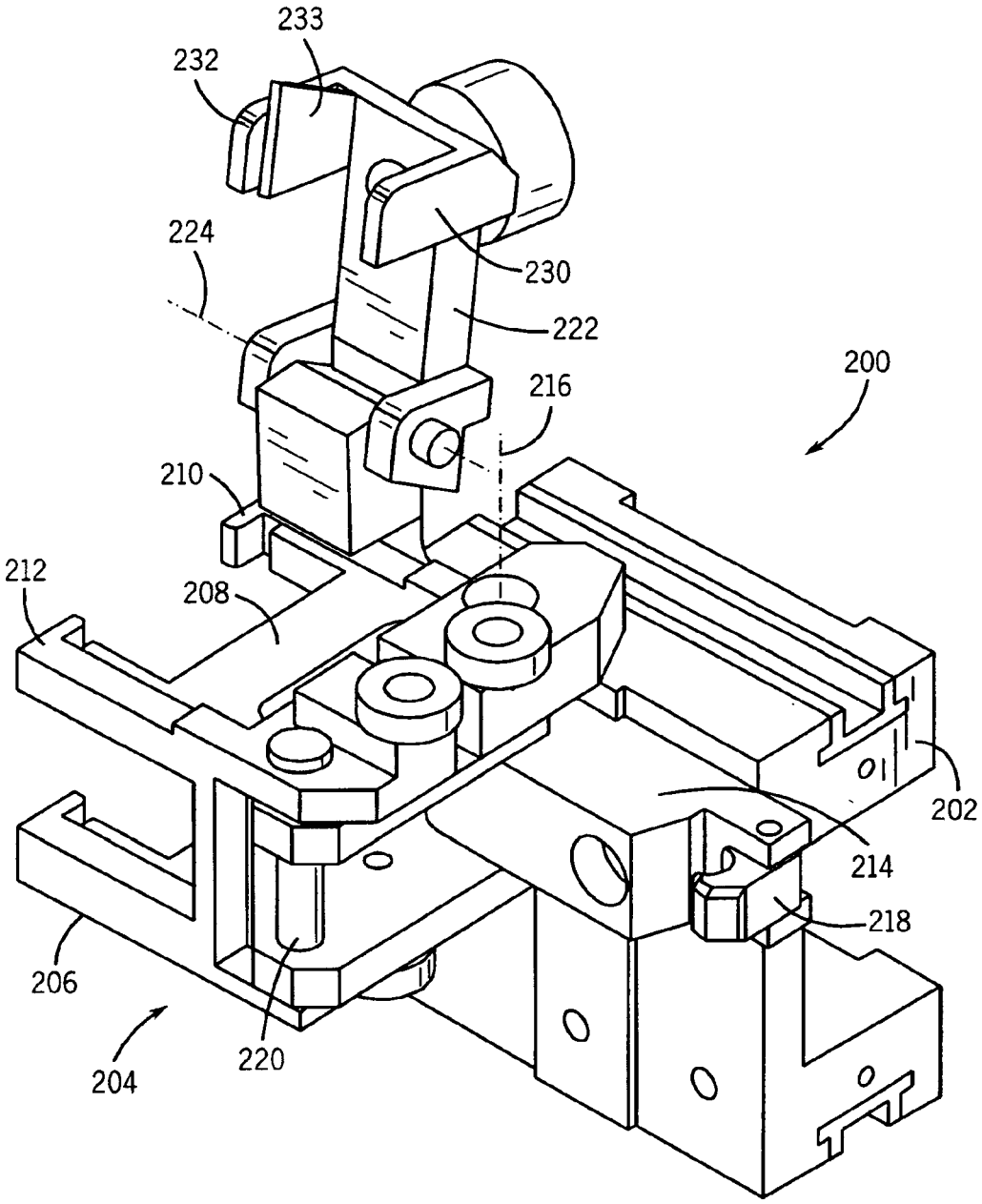
FIG. 9 is a perspective view of the mandrel of FIG. 6 with the package-holding assembly in a fully rotated position.
Figure 10:
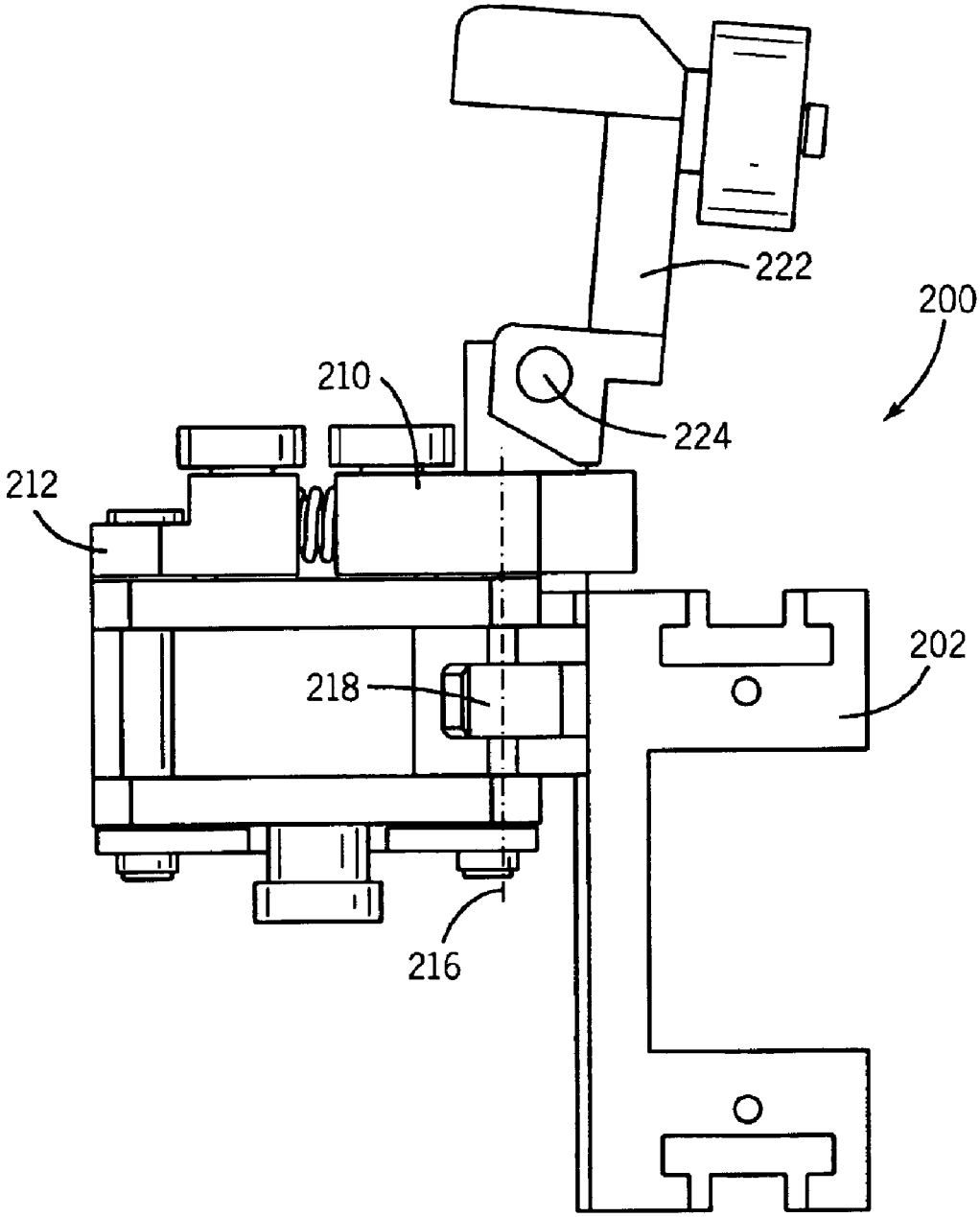
FIG. 10 is a side view of the mandrel of FIG. 9.
Figure 11:
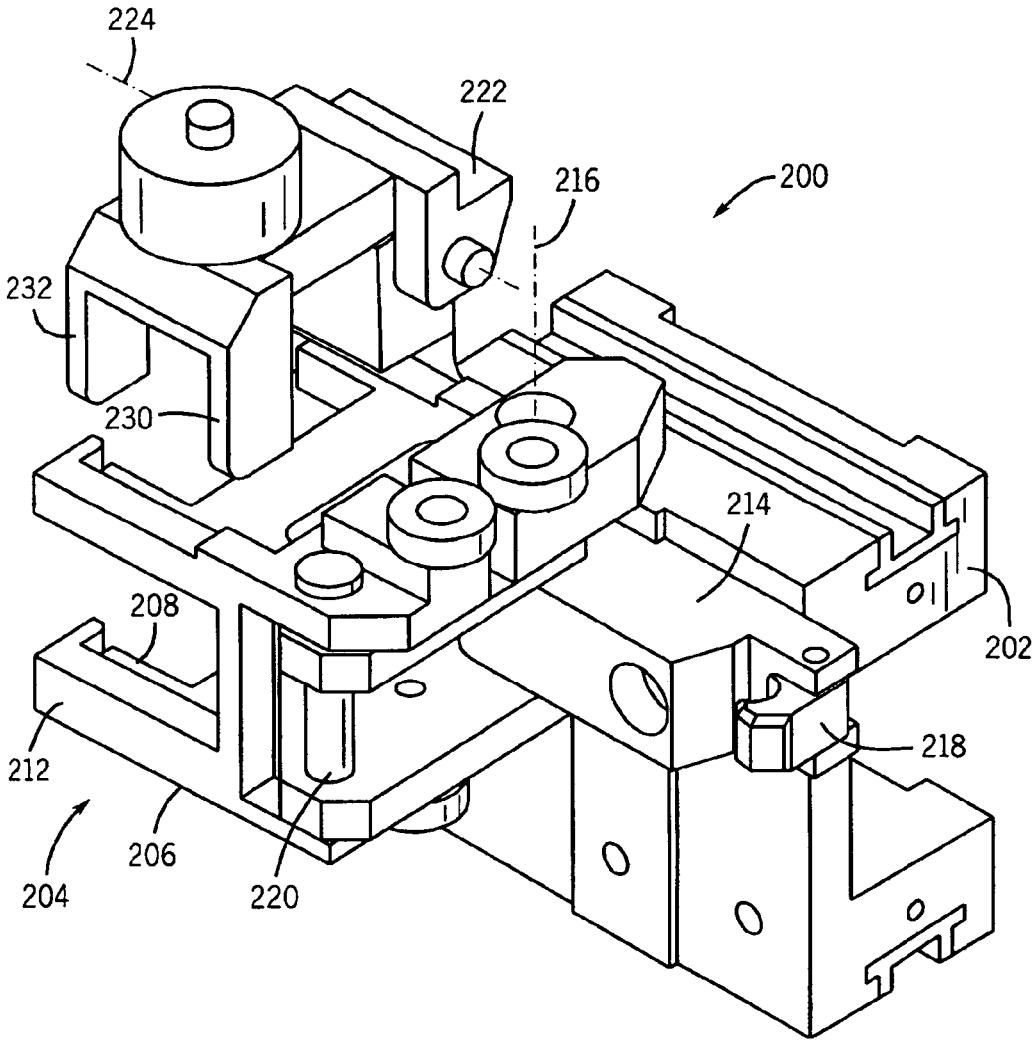
FIG. 11 is a perspective view of the mandrel of FIG. 6 with the package-holding assembly in a fully rotated position and a flap holder assembly in a fully rotated position.
Figure 12:
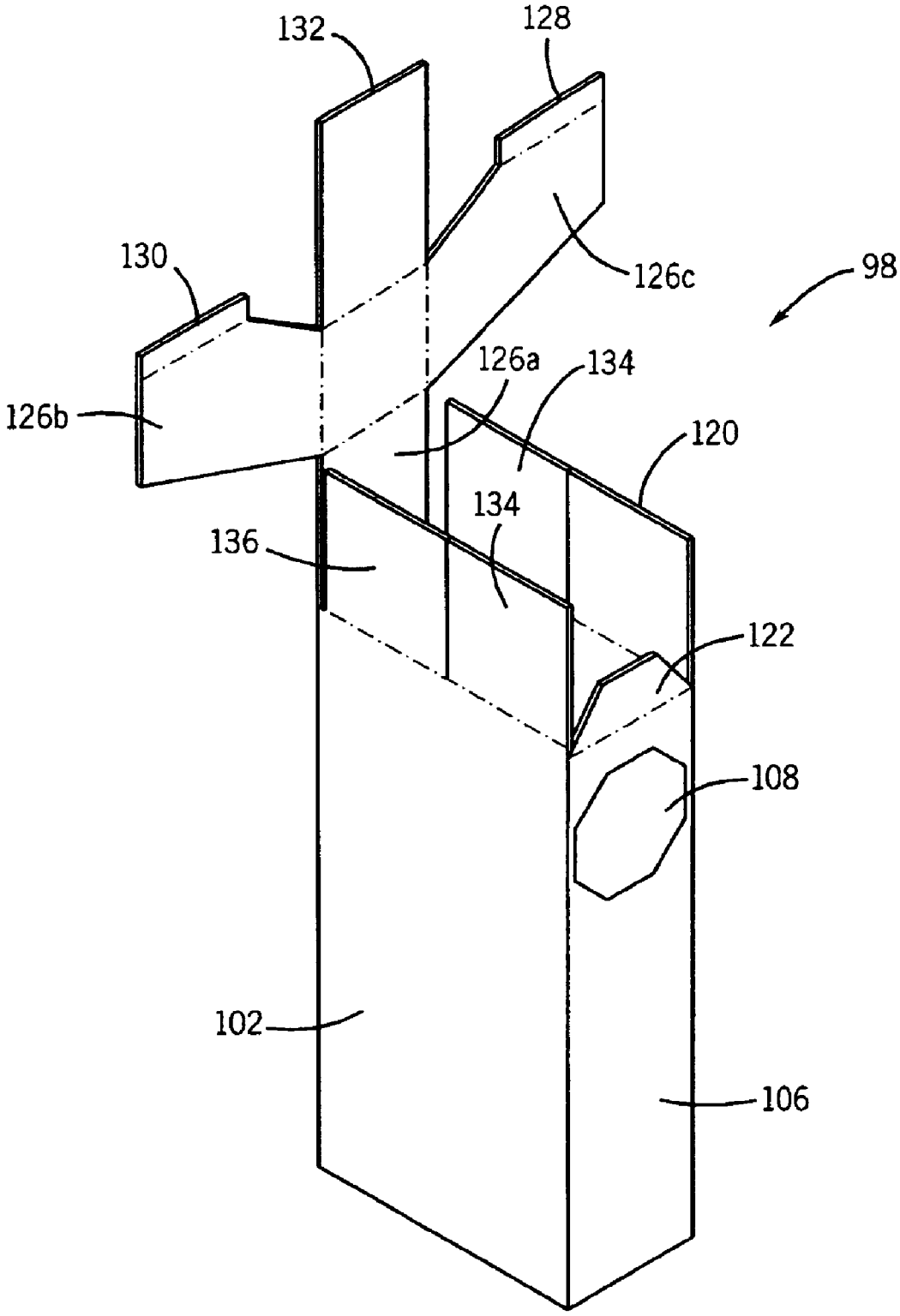
FIG. 12 is a perspective view of a partially assembled partial flip-top package.
Figure 13:
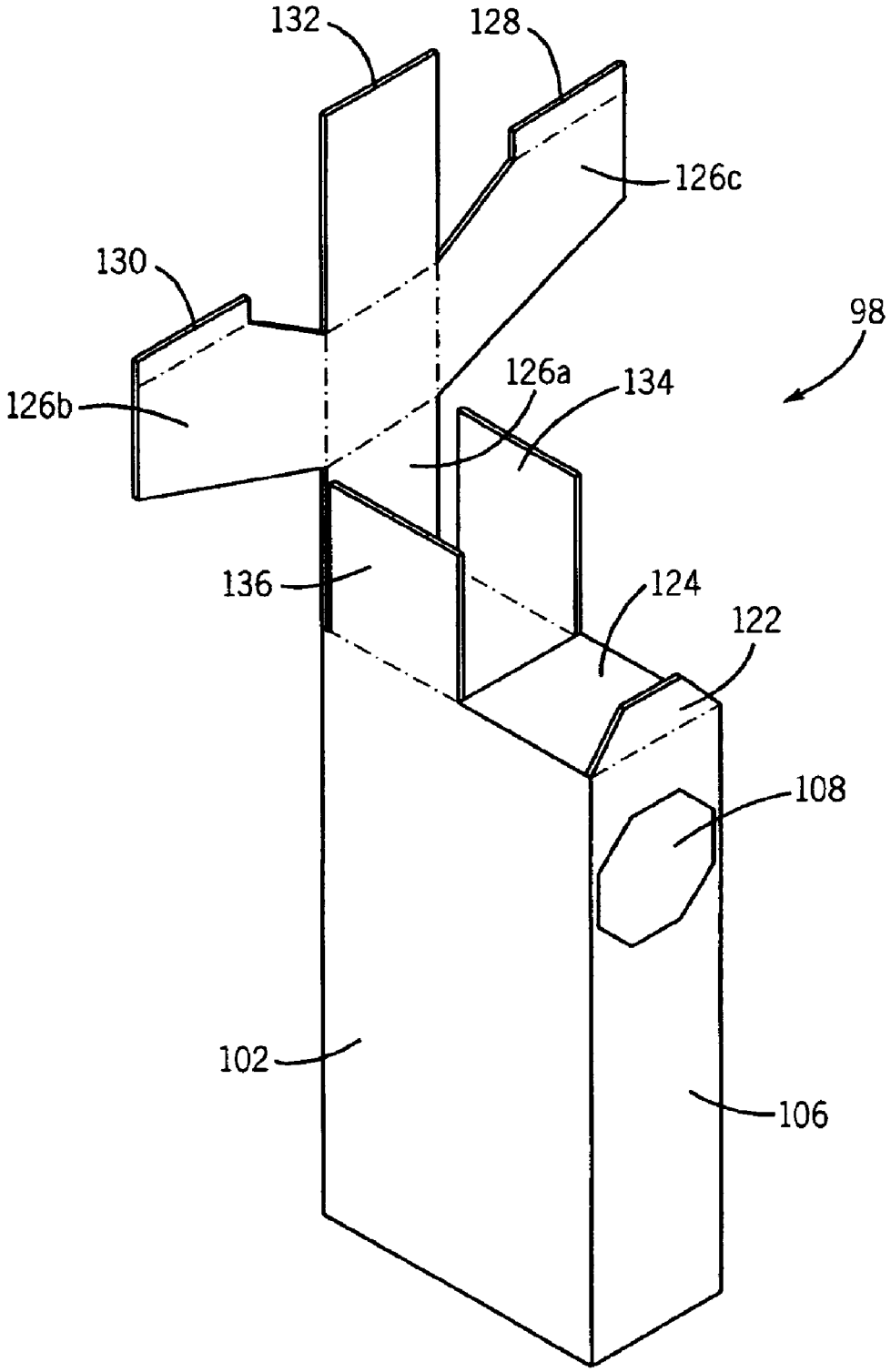
FIG. 13 is a perspective view of a partially assembled partial flip-top package in its state as the package-holding assembly is being rotated.

FIG. 5 shows a paperboard package blank 99 that is ultimately assembled into the package 98 shown in FIGS. 3–4. The package blank 99 includes a first major side 100, a second major side 102, a first minor side 104 and a second minor side 106. The second minor side 106 includes a hole 108 prepunched therein. When the package 98 is fully assembled and filled, the packaged product is ejected through the hole 108. An inner panel 110 is attached to the edge of the second minor side 106 opposite the second major side 102. According to one particular preferred embodiment, the inner panel 110 is pre-secured to the inside of the first major side 100 before the blank 99 enters the package machine. Preferably glue or some other type of adhesive or adhesion method is used to secure the inner panel 106 to the first major side 100.

The bottom of the package is formed by the combination of a first minor lower flap 112, a second minor lower flap 114, a first major lower flap 116 and a second major lower flap 118. As is discussed herein, in the most preferred embodiment these flaps are sequentially folded during the assembly process such that the second major lower flap is the outermost flap when the package 98 is completed, serving as the "bottom" of the package.

A latching panel 122 is coupled to the top of the second minor side 106. The latching panel 122 is folded downward during the assembly process. When the package 98 is fully assembled, the latching panel 122 will come into contact with the underside of the flip-top 101, providing a certain degree of resistance and helping to keep the flip-top 101 in the closed position relative to the rest of the package 98. The flexibility of the latching panel 122 enables it to be released from the flip-top 101 when the flip-top 101 is manually opened to the position shown in FIG. 4. Yet, the resilience of the latching panel 122 is such that the flip-top 101 is again captured when closed.

A first front upper panel 124 is coupled to the first major side 100, and a second front upper panel 120 is coupled to second major side 102. Similarly, a first rear upper panel 134 is coupled to the first major side 100; and a second rear upper panel 136 is coupled to the second major side 102. As will be discussed herein, the first and second front upper panels 124 and 120 eventually cooperate to the top portion of the package 98 between the flip-top 101 and the rest of the package 98, the first and second rear upper panels 134 and 136 eventually cooperating to form the top of the package 98 behind the flip-top 101.

The flip-top 101 of the package 98 is formed by the folding of several sequential panels as is discussed herein. A rear flip-top panel **126*a* is coupled to the first minor side 104 on one edge and an intermediate flip-top panel 127 on an opposite edge. A front flip-top panel 132 is coupled to the intermediate flip-top panel 127 on an edge of the intermediate flip-top panel 127 opposite the rear flip-top panel 126*a*. First and second flip-top wing panels 126*b* and 126*c*, respectively, are also coupled to the intermediate flip-top panel 127 on opposite sides thereof. The first flip-top wing panel 126***b* has a first wing panel 128 coupled to one edge thereof. Similarly, the second flip-top wing panel 126*c* has a second wing panel 130 coupled to one edge thereof.

The back of the top portion of the package 98 is formed by the subsequent folding of a first rear upper panel 134 and a second rear upper panel 136. The first rear upper panel 134 is connected to the first major side 100, and the second rear upper panel 136 is coupled to the second major side 102.

The present invention provides an automatic packaging machine which forms, fills and closes the package shown and described in FIGS. 3–5 and FIGS. 12–13, by use of a mandrel 200 shown in FIGS. 6–11.

Figure 2:
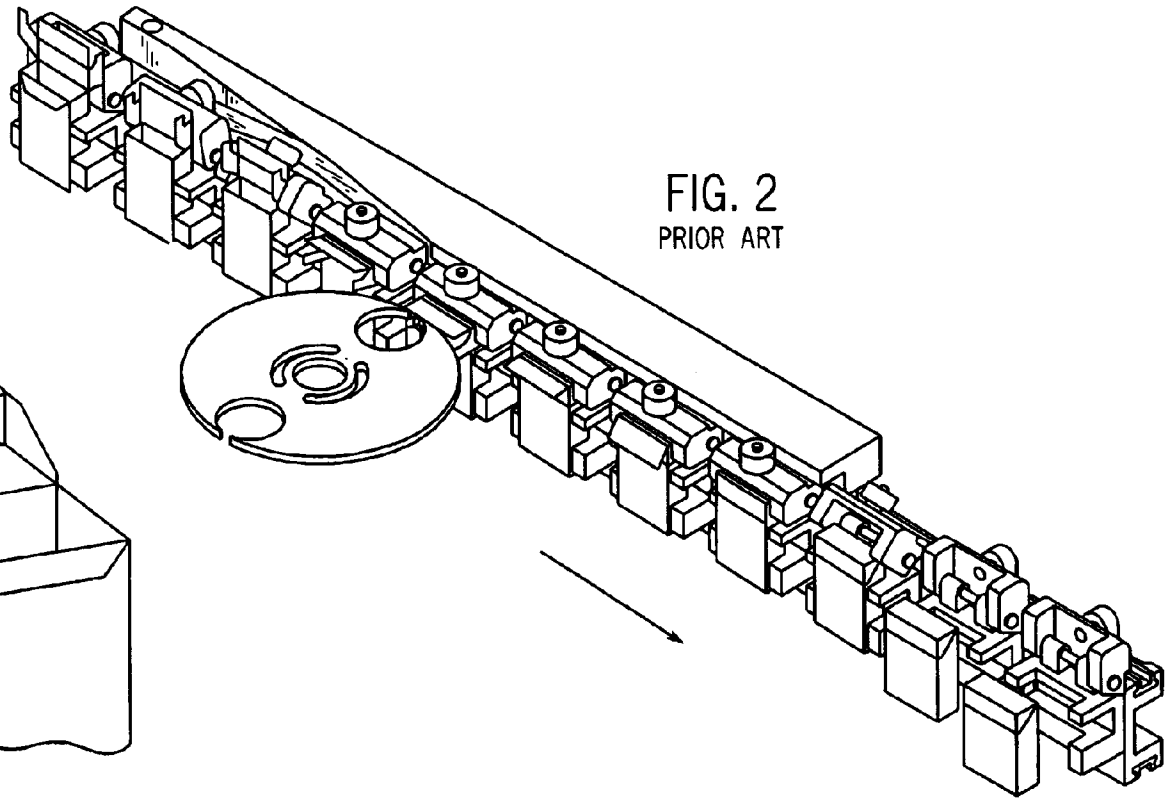
FIG. 2 PRIOR ART
FIG. 2 is a perspective view of a prior art automatic packaging machine for assembling the flip-top package of FIG. 1.
Figure 1:
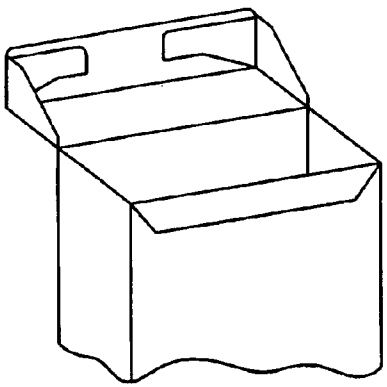
FIG. 1 PRIOR ART
FIG. 1 is a partial perspective view of a prior art latching flip-top package.

The automatic packaging machine comprises a plurality of the mandrels 200 coupled to a conveyor system. An example of a conventional conveyor system is shown in prior art FIG. 2. As shown in FIGS. 6–11, each of the mandrels 200 comprises a mounting block 202 that couples the mandrel 200 to a suitable conveyor, an example of which is shown in prior art FIG. 2, so that the mandrel 200 is carried by and moves with the conveyor. In one embodiment of the invention, the conveyor comprises a link chain. The mounting block 202 is operatively connected to a package-holding assembly 204. The package-holding assembly 204 includes a movable gripper 206 surrounding a guide mechanism 208 for holding a package blank 99 during assembly. The gripper 206 includes a first gripper half 210 and a second gripper half 212, each of which is capable of moving away from each other in order to allow a package blank 99 to be placed within the guide mechanism 208. After the blank is placed within the guide mechanism 208 first gripper half 210 and the second gripper half 212 move towards each other. It is also possible that the first gripper half 210 can be formed from two pieces, as can the second gripper half 212 and the guide mechanism 208.

Each mandrel 200 includes a support member 214 connected to a side of the mounting block 202. The package-holding assembly 204 is rotatably connected to the support member 214 at a first axis 216. A latching member 218 is attached to the support member 214 at an end substantially opposite the first axis 216. The latching member 218 is capable of capturing and fixing the position of a bushing 220 on the package-holding assembly 204. When the latching member 218 releases the bushing 220, the package-holding assembly 204 is capable of rotating about the first axis 216, which is substantially vertical according to one preferred embodiment of the invention.

Each of the mandrels 200 also includes a flap holder assembly 222 operatively connected to the support member 214. The flap holder assembly 222 is rotatable about a second axis 224 which is substantially perpendicular to the first axis 216. The flap holder assembly 222 is used primarily to push down the rear flip-top portion 126*a* and also push down the connected portions that comprise the flip-top 101 towards the rest of the package 98.

Figure 14:
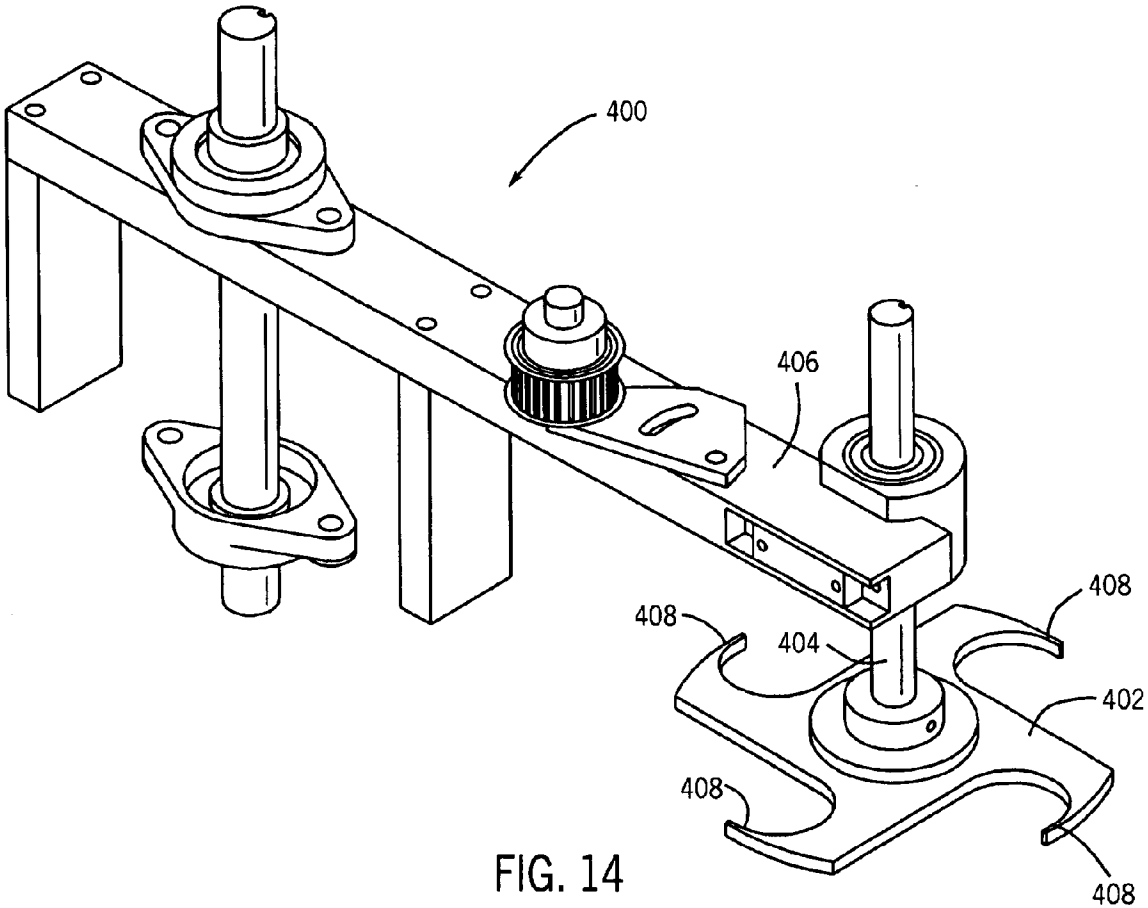
FIG. 14 is a perspective view of a first tucker assembly for folding two of the panels of the partial flip-top package of FIG. 3.
Figure 15:
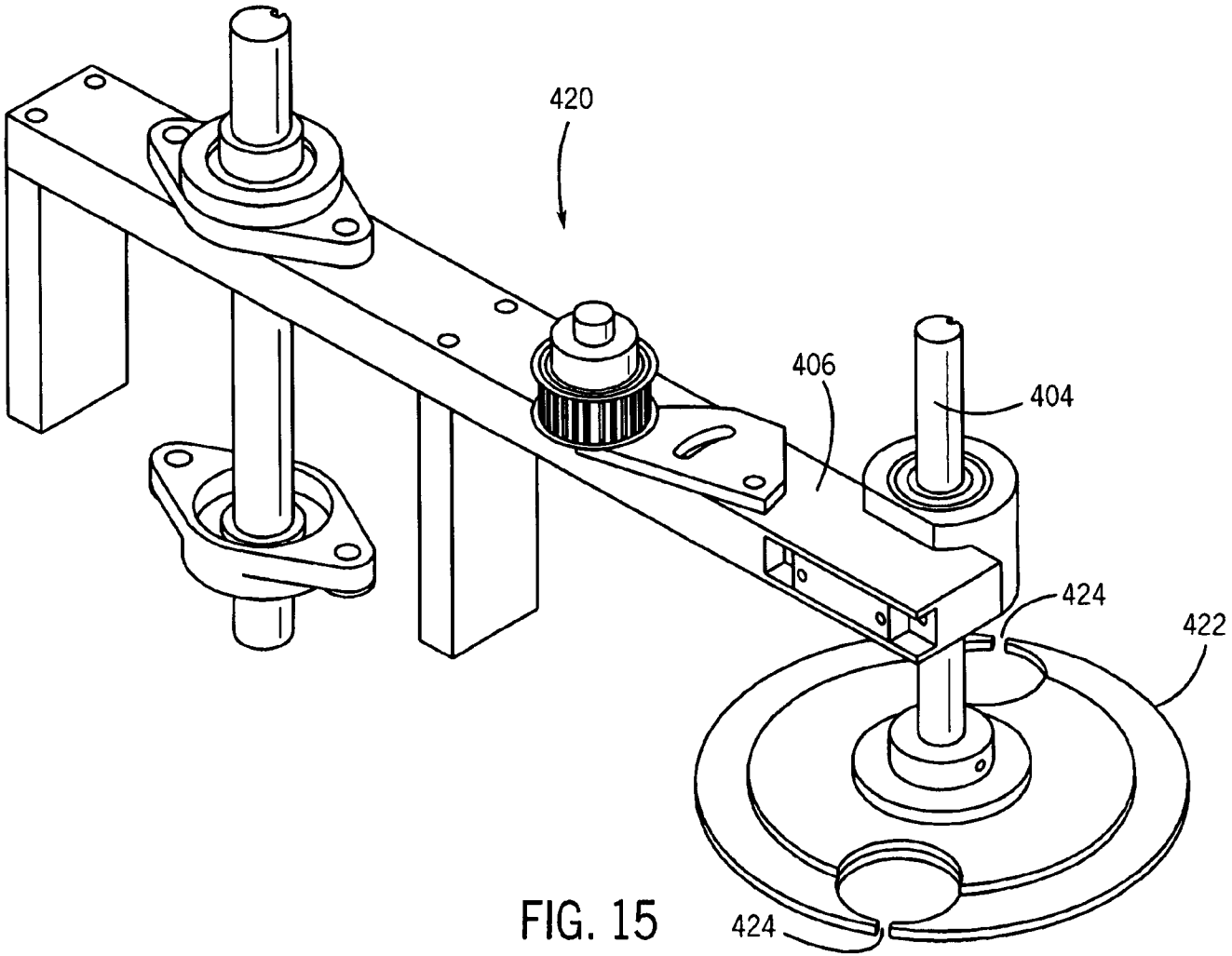
FIG. 15 is a perspective view of a second tucker assembly for folding two of the panels of the partial flip-top package of FIG. 3.

According to a preferred embodiment shown in FIGS. 14–15, a first tucker assembly 400 and a second tucker assembly 420 are used to make additional folds in the package 98. Both the first tucker assembly 400 and the second tucker assembly 420 are attached to the package machine and strategically located to come into contact with multiple panels.

The first tucker assembly 400 comprises a first tucker 402 with multiple flanges 408. The first tucker 402 is coupled to a rotatable shaft 404 which is operatively connected to a transverse member 406, with the transverse member 406 ultimately connected to the rest of the machine of the present invention. The second tucker assembly 420 comprises a second tucker 422 including a pair of slots 424 and is operatively connected to the rest of the package machine in a manner substantially identical to that of the first tucker 402.

The first tucker 402 is positioned such that the leading edges of two of its flanges 408 sequentially come into contact with the second front upper panel 120 and the latching panel 122, pushing both panels downward and into the appropriate positions. Similarly, the pair of slots 424 on the second tucker 422 sequentially "catch" the first wing panel 128 and the second wing panel 130, folding them inward to their new positions.

Figure 18:
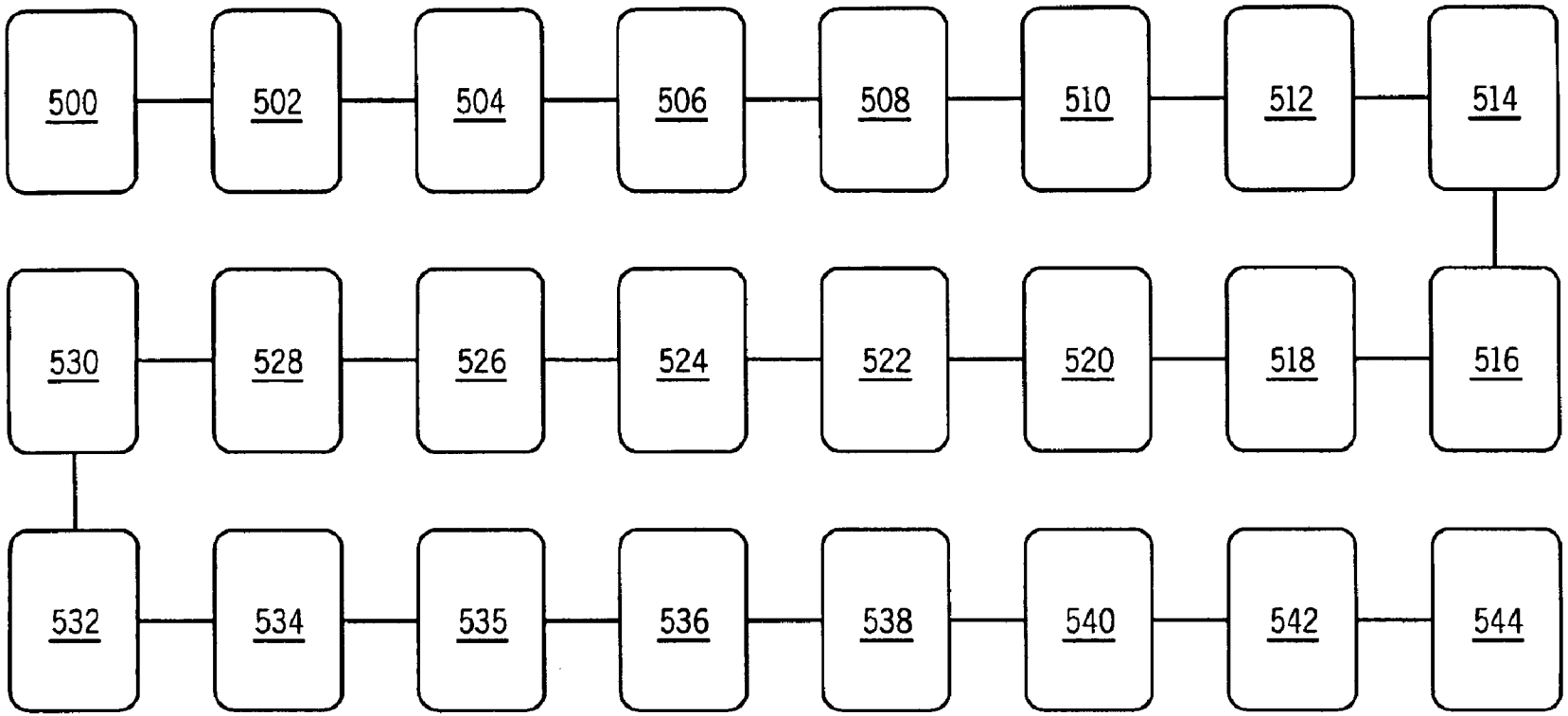
FIG. 18 is a flow chart representing the package assembly process according to one embodiment of the invention.

The assembly of the package 98 in a most preferred embodiment is generally as follows and as represented in FIG. 18. As discussed above, glue or some other type of conventional adhesion method is used to secure the inner panel 106 to the first major side 100 before the package blank 99 is placed into the machine. The package blank 99 is moved into the machine by use of a plurality of suction devices (not shown) that "grab" the package blank 99 and transport it to a mandrel 200. Before receiving the package blank 99, the first gripper half 210 and the second gripper half 212 open, shown at 500, to allow the package blank 99 to enter the guide mechanism 208, shown at 502. After the package blank 99 has been inserted into guide mechanism 208, the first gripper half 210 and the second gripper half 212 close, shown at 504.

After the package blank 99 is placed within the guide mechanism 208, the mandrel 200 moves along a conveyor. At step 506, the first minor lower flap 112 comes into contact with a first plow (not shown), folding the first minor lower flap 112 inward. The second minor lower flap 114 is then folded inward by a second plow (not shown), shown at step 508. The first major lower flap 116 then comes into contact with a third plow (not shown), folding the first major lower flap 116 inward at 510. A glue or some other type of adhesive is then applied to the exposed side of the first major lower flap 116, shown at step 512. Immediately thereafter, a fourth plow (not shown) folds the second major lower flap 118 onto the first major lower flap 116, shown at 514.

At this stage, the bottom of the package 98 is completely assembled. At step 516, a cam on the machine acts against the mandrel 200, causing the latching member 218 to disengage from the bushing 220 and causing the package-holding assembly 204 to rotate approximately ninety degrees about the first axis 216 from the position shown in FIGS. 6–7 to the position shown in FIGS. 9–10.

Once the package-holding assembly 204 has been rotated ninety degrees, the mandrel 200 reaches the first tucker assembly 400. At step 518, one of the flanges 408 of the first tucker 402 comes into contact and folds down the second front upper panel 120. This is followed at step 520 by another of the flanges 408 of the first tucker 402 coming into contact with the latching panel 122, folding it downward and outward from the center of the package 98. This moves the latching panel 122 into a loosely folded position where it is later caught by the panels on the flip-top 101, thereby creating a latching condition. Glue or another type of adhesive is then placed on the exposed surface of the second front upper panel 120, shown at 522. This is followed at step 524 by a fifth plow (not shown) coming into contact with and folding down the first front upper panel 124 onto the exposed surface of the second front upper panel 120.

At step 526, the flap holder assembly 222 is rotated approximately ninety degrees about the second axis 224.

This action causes the front flip-top panel 132 to fold downward towards the rest of the package 98. Simultaneously, first and second side members 230 and 232 on the flap holder assembly 222 come into contact with the first and second flip-top wing panels 126*b* and 126*c*, respectively, causing them to fold inward (if necessary, a small spacer 233 can be used to achieve a precise alignment and positioning of the first and/or second flip-top wing panels 126*b* and 126*c*).

The mandrel 200 then reaches the second tucker assembly 420. The slots 424 on the second tucker 422 then sequentially grab and fold the first wing panel 128 and the second wing panel 130 inward, shown at steps 528 and 530. At step 532, glue or another type of adhesive is then applied to the exposed surfaces of the first and second wing panels 128 and 130. It is also possible to locate the glue or another type of adhesive on the underside of the front flip-top panel 132. A sixth plow 300 is then used at step 534 to fold the front flip-top panel 132 downward and secure it to the exposed sides of the first and second wing panels 128 and 130. This effectively forms the lid 101 of the package 98.

At step 535, the package-holding assembly 204 is rotated back about the first axis 216 from the second position to the first position. The next step of the process, represented at 536, involves the package-holding assembly 204 rotating back to its original position. This can be accomplished by the use of a cam or other conventional system known to those skilled in the art. At step 538, a seventh plow 302 contacts and folds downward a first rear upper panel 134. At step 540, glue or another type of adhesive is applied to the exposed side of the first rear upper panel 134. This is followed at step 542 by an eighth plow (not shown) contacting and folding downward the second rear upper panel 136 onto the exposed surface of the first rear upper panel 134. At step 544, the completed package 98 is discharged from the mandrel 200, where any suitable means is provided to carry the box 98 away for disposition.

Figure 17:
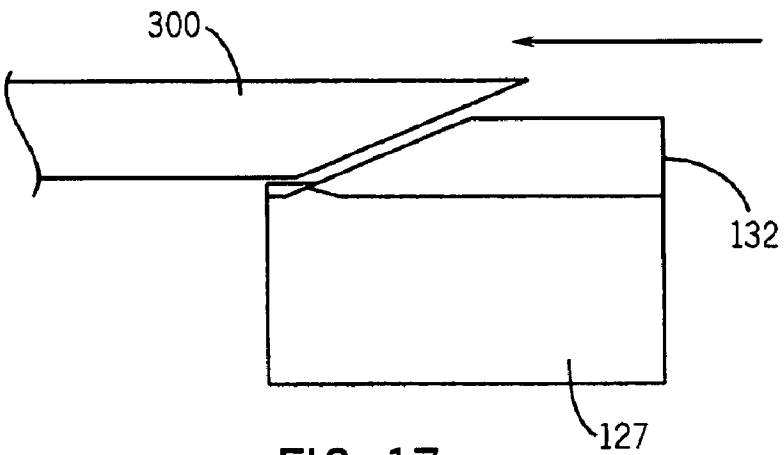
FIG. 17 is a representation of another plow folding the first rear upper panel.
Figure 16:
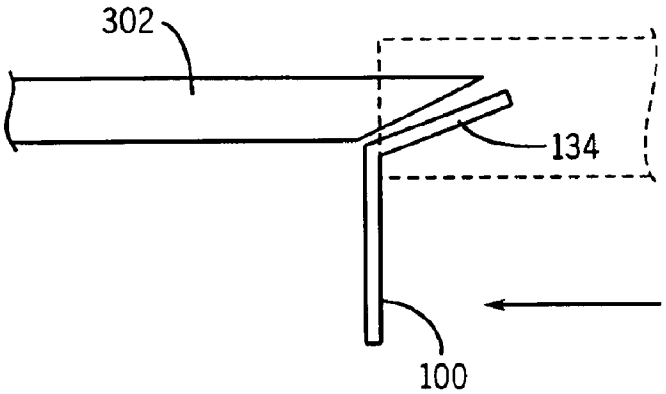
FIG. 16 is a representation of one plow folding the top flip-top panel.

As discussed above, a series of plows are provided for making a series of strategic folds in the package 98. FIGS. 16 and 17 illustrate how two exemplary plows operate to fold individual panels. In FIG. 17, the sixth plow 300 is used to fold the front flip-top panel 132. In FIG. 16, the seventh plow 302 is used to fold down the first rear upper panel 134. A series of other plows (not shown) are used through the assembly process to make other folds in a manner that is known to those skilled in the art. According to a preferred embodiment of the invention, all of the plows remain stationary during the assembly process, while each individual mandrel 200 moves the packages 98 into contact with the plows.

At one stage during the package assembly process, the product to be packaged is deposited into the partially-completed package 98. In one preferred embodiment of the invention, this occurs between steps 514 and 516, when the bottom of the package 98 has been completely assembled; but the top of the package 98 remains open. However, it is possible that the filling of the package could occur at some other time. The filling process is performed automatically by methods known by those skilled in the art.

Using the preferred system described herein, up to about 400 packages can be assembled per minute, while maintaining a fully automated system.

It should be understood that the above description of the invention and the specific examples and embodiments, while indicating the preferred embodiments of the present invention, are given by demonstration and not limitation. For example, it is possible to use different types of tuckers and plows in various orders to complete the assembly of the package 98. Many changes and modifications within the scope of the present invention may therefore be made without departing from the spirit of the invention, and the invention includes all such inventions and modifications.

What is claimed is:

1. An automatic packaging machine for forming a latching flip-top box from a blank, comprising:

a conveyor system;

a plurality of mandrels coupled to the conveyor system, each of the plurality of mandrels comprising:

a mounting block for coupling the mandrel to the automatic packaging machine, a package-holding assembly operatively connected to the mounting block, the package-holding assembly rotatable about a first axis relative to the direction of travel of the respective mandrel from a first position to a second position; and a flap holder assembly operatively connected to the mounting block, the flap holder assembly rotatable about a second axis relative to the direction of travel of the respective mandrel, the second axis being substantially perpendicular to the first axis, a plurality of plows, each of the plurality of plows manipulating a portion of the blank in order to form portions of the box; and a plurality of tucker assemblies, each of the plurality of plows manipulating a portion of the blank in order to form portions of the box.

2. The automatic packaging machine of claim 1, wherein each of the plurality of mandrels includes a lateral support member coupled to the mounting block, wherein the package-holding assembly is rotatably connected to the lateral support member.

3. The automatic packaging machine of claim 2, wherein each of the plurality of mandrels includes means for maintaining the package-holding assembly in the first position relative to the lateral support member.

4. The automatic packaging machine of claim 2, wherein the flap holder assembly includes a plurality of side arms for manipulating portions of the blank.

5. The automatic packaging machine of claim 1, wherein the package-holding assembly comprises a plurality of gripping arms, the plurality of gripping arms selectively permitting a package blank to be captured by the package-holding assembly.

6. The automatic packaging machine of claim 5, wherein the package-holding assembly further comprises a guide mechanism positioned within the plurality of gripping arms, the guide mechanism holding the package blank during the assembly thereof.

7. An automatic packaging machine for forming a latching flip-top box from a blank, comprising:

a conveyor system;

a plurality of mandrels coupled to the conveyor system, each of the plurality of mandrels comprising:

a mounting block for coupling the mandrel to the automatic packaging machine, a package-holding assembly operatively connected to the mounting block, the package-holding assembly rotatable about a first axis from a first position to a second position; and a flap holder assembly operatively connected to the mounting block, the flap holder assembly rotatable about a second axis substantially perpendicular to the first axis, a plurality of plows, each of the plurality of plows manipulating a portion of the blank in order to form portions of the box; and a plurality of tucker assemblies, each of the plurality of plows manipulating a portion of the blank in order to form portions of the box, wherein each of the plurality of mandrels includes a lateral support member coupled to the mounting block, wherein the package-holding assembly is rotatably connected to the lateral support member, each of the plurality of mandrels includes means for maintaining the package-holding assembly in the first position relative to the lateral support member, and wherein the maintaining means comprises a latching member coupled to the lateral support member, the latching member releaseably mating with a bushing on the package-holding assembly.

8. The automatic packaging machine of claim 7, wherein the package-holding assembly comprises a plurality of gripping arms, the plurality of gripping arms selectively permitting a package blank to be captured by the package-holding assembly.

9. The automatic packaging machine of claim 8, wherein the package-holding assembly further comprises a guide mechanism positioned within the plurality of gripping arms, the guide mechanism holding the package blank during the assembly thereof.

10. The automatic packaging machine of claim 7, wherein the flap holder assembly includes a plurality of side arms for manipulating portions of the blank.

* * * * *